US005536383A

United States Patent [19]

Van Danh et al.

[11] Patent Number: 5,536,383

[45] Date of Patent: Jul. 16, 1996

[54] SUSPENSION FOR THE DEPOSITION OF LUMINESCENT MATERIALS BY ELECTROPHORESIS PARTICULARLY FOR PRODUCING FLAT SCREENS

[75] Inventors: Tran Van Danh, Crolles; Joël Danroc, Grenoble, both of France

[73] Assignee: Commissariat a L'Energie Atomique, Paris, France

[21] Appl. No.: 545,171

[22] Filed: Oct. 19, 1995

[30] Foreign Application Priority Data

Nov. 8, 1994 [FR] France ..... 94 13370

[51] Int. Cl.[6] ..... C25D 13/02

[52] U.S. Cl. ..... 204/490; 252/301.36

[58] Field of Search ..... 204/490; 252/301.36

[56] References Cited

U.S. PATENT DOCUMENTS

| | | | |
|---|---|---|---|
| 2,982,707 | 5/1961 | Scheible | 204/181 |
| 3,466,237 | 9/1969 | Barber | 204/491 |
| 3,714,011 | 1/1973 | Grosso et al. | 204/490 |
| 4,891,110 | 1/1990 | Libman et al. | 204/490 |
| 5,057,196 | 10/1991 | Creech et al. | 204/491 |

FOREIGN PATENT DOCUMENTS 1425562 4/1966 France .

OTHER PUBLICATIONS

Journal of the Electrochemical Society, vol. 109, No. 10, pp. 923–927, Oct. 1962, C. Gutierrez, et al., "Electrophoretic Deposition: A Versatile Coating Method".

*Primary Examiner*—John Niebling
*Assistant Examiner*—Kishor Mayekar
*Attorney, Agent, or Firm*—Oblon, Spivak, McClelland, Maier & Neustadt

[57] ABSTRACT

The invention relates to non-aqueous suspensions for the deposition of luminescent materials, particularly phosphors by electrophoresis. These suspensions comprise an organic, polar solvent constituted by a mixture of nitromethane and an aliphatic alcohol such as isopropyl alcohol, containing in solution at least one metal salt and at least one vegetable protein, as well as a powder of the luminescent material to be deposited in suspension in said solvent. These suspensions can be used for the production of tricolour screens having conductor tracks (15, 16, 17) covered with first colour (18), a second colour (19) and a third colour (20), the excitation of the phosphors being carried out by means of an electron source (1) having an emissive cathode with microtips (1*c*).

16 Claims, 1 Drawing Sheet

SUSPENSION FOR THE DEPOSITION OF LUMINESCENT MATERIALS BY ELECTROPHORESIS PARTICULARLY FOR PRODUCING FLAT SCREENS

FIELD OF THE INVENTION

The present invention relates to non-aqueous suspensions for the deposition of luminescent materials by electrophoresis more particularly intended for the production of flat screens.

BACKGROUND OF THE INVENTION

It more particularly applies to simple displays permitting the display of fixed images or pictures, as well as the production of complex, multiplexed screens permitting the display of moving pictures, e.g. of the television picture type.

It is of particular interest for field emission-excited cathodoluminescence display means, comprising a microtip emissive cathode electron source. Display means of this type are e.g. described in FR-A-2 687 839, FR-A-2 633 763 and U.S. Pat. No. 5,231,387.

FIG. 1 shows a display of this type having a microtip electron source 1, which has the insulating substrate 1*a*, resistive layer 1*b*, microtips 1*c*, insulating layer 1*d* and a grid 1*e*. A space 3 in which is formed a vacuum separates said microtip source 1 from an electrically insulating, transparent substrate 5 provided with an electrically conductive, transparent layer forming an anode. On said anode is provided, facing the microtip source, a layer 9 of a cathodoluminescent material also known as a phosphor.

Under the impact of the electrons emitted by the microtips 1*c* when the source is functioning, said layer 8 emits a light 11, which a screen user 13 observes through the transparent substrate 5. Therefore with said screen the phosphor is observed from the side opposite to its excitation.

In the case of microtip flat screens, the electrons are accelerated at very low voltages (a few hundred volts) compared with the voltages used in cathode screens (20 to 25 kV). Therefore, in such screens, the phosphors are essentially surface excited and must have a minimum pollution. A contamination or the presence of a thin layer or film on the surface of the phosphor grains will lead to a reduction in the light output. Therefore the quality of the deposited phosphor layer is an important parameter.

In the case of flat microtip screens, the deposition of the phosphor layer must take place on a transparent, insulating substrate having a transparent, conductive coating, e.g. of indium and tin oxide (ITO). Moreover, for colour display, the screen must have three groups of conductor tracks having a width of a few dozen micrometers and on which will be respectively deposited the phosphors corresponding to red, blue and green.

To obtain a satisfactory quality, the different deposited layers must have the following properties: good adhesion to the substrate, thickness homogeneity, high degree of purity for avoiding mixtures of colours and composition adapted to the deposition mode. In addition, the deposition procedure must be reproducible, easy to perform and appropriate for high mass production rates.

Another important condition which must be fulfilled is that the transparent, conductive coating forming the conductors, e.g. of indium and tin oxide, must withstand the phosphor deposition conditions, i.e. must maintain its transparency and electrical conductivity.

A widely used procedure for producing deposits of this type is electrophoresis, according to which the phosphor particles are deposited from a suspension thereof, under the action of an electric field, the part to be coated serving as the anode (anaphoresis) or cathode (cataphoresis).

FR-A-2 532 957 describes non-aqueous suspensions permitting the deposition of phosphor powders by anaphoresis. The liquid phase of the suspension used is constituted by a ketone-based solvent containing a dispersing agent constituted by nitrocellulose, as well as a strong acid and a strong base for giving the suspension an adequate conductivity. With such suspensions the deposition time is approximately 0.3 sec.

The use of this procedure makes it possible to avoid a deterioration of the conductive, transparent layer of the deposition electrode, because the latter takes place by anaphoresis using the substrate in the anode position, which avoids the appearance of $H^+$ ions on the electrode. However, as the deposition period is very short, it is not possible to guarantee the obtaining of a reproducible, homogeneous thickness of the deposited layers. Thus, the light outputs of the screens are not reproducible and the appearance is not uniform.

U.S. Pat. No. 3,714,011 describes a procedure for depositing phosphors by cataphoresis. The suspension used is a non-aqueous suspension for avoiding the problems linked with the present of $H^+$ ions on the electrode. Such a suspension can be constituted by an organic solvent containing a water-miscible, cathodic depolarizing agent, such as acetone, a little water and a metal salt such as hydrogenated magnesium nitrate, which makes it possible to electrically charge the phosphor particles and serve as a binder making it possible to obtain a highly adhesive coating. The organic solvent can be isopropanol.

This cataphoresis-based deposition procedure is not satisfactory in the case where the substrate has a transparent, electrically conductive indium and tin oxide film, because the latter is unable to withstand the deposition conditions, being reduced and consequently loses its transparency.

The present invention relates to a non-aqueous suspension for the deposition by cataphoresis of luminescent materials, particularly phosphors, which makes it possible to obviate this disadvantage.

SUMMARY OF THE INVENTION

According to the invention, the suspension for the deposition of a luminescent material by electrophoresis comprises:

- a polar, organic solvent constituted by a mixture of nitromethane and an aliphatic alcohol, excepting methyl alcohol, containing in solution at least one metal salt and at least one vegetable protein and
- a luminescent material powder to be deposited in suspension in said solvent.

According to the invention, due to the addition of nitromethane to the alcohol-based organic solvent, during the deposition of the luminescent material it is possible to avoid the reduction and loss of transparency of the deposition substrate when the latter is an indium and tin oxide (ITO). Moreover, due to said nitromethane addition, the same bath can be used and there is no destruction of ITO, no matter what the luminescent material, e.g. phosphor used.

DETAILED DESCRIPTION OF THE INVENTION

Figure 1:
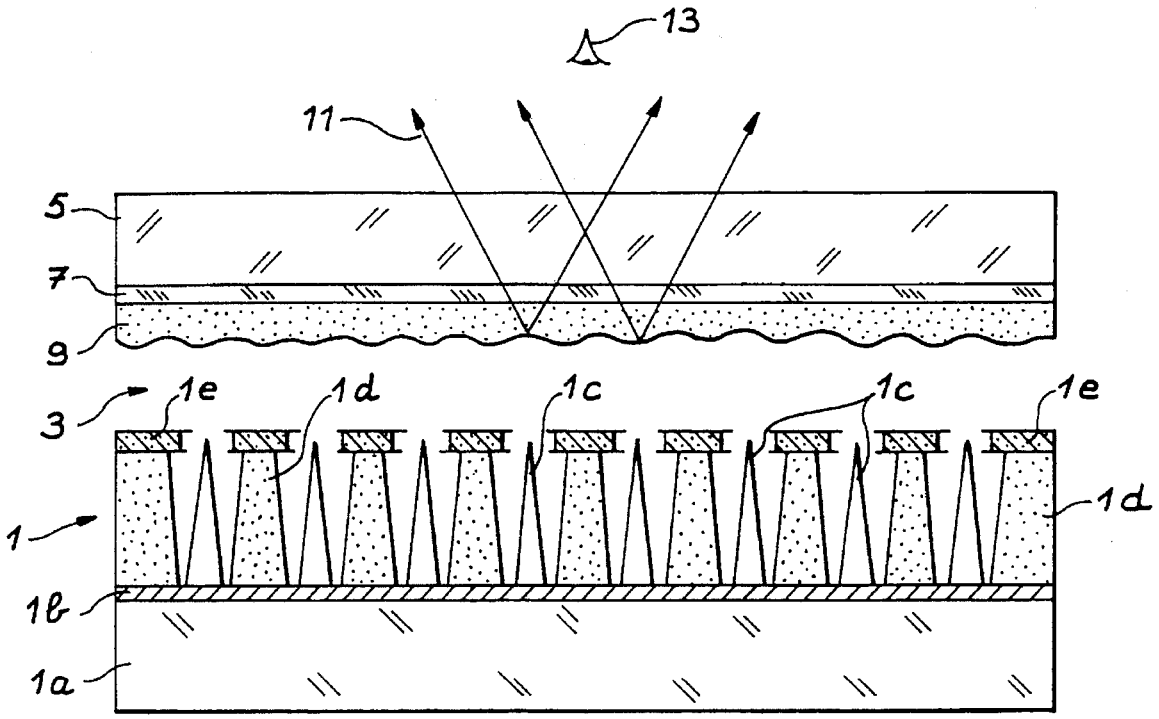

The aliphatic alcohols usable in conjunction with the nitromethane in the organic solvent can be of different types. It is possible to use ethyl alcohol or isopropyl alcohol, preference generally being given to the latter.

The nitromethane content of the organic solvent must be adequate for it to prevent the deterioration of the transparent film and it is generally 1 to 90 vol. %. Good results are obtained with an organic solvent comprising 40 vol. % nitromethane and 60 vol. % isopropyl alcohol.

The organic solvent phase of the deposition suspension also comprises at least one mineral salt serving as an inorganic binder and improving the adhesion of the deposited luminescent material layer. The mineral salts used for this purpose can be of different types. For example, they can belong to the family of salts of rare earths and alkaline earth metal salts. It is also possible to use thorium, aluminium and/or cobalt salts. Preferably, the salt is in the form of a hydrogenated nitrate, e.g. $Mg(NO_3)_2$, $6H_2O$; $La(NO_3)_3$, $6H_2O$; $Al(NO_3)_3$, $9H_2O$; $Th(NO_3)_4$, xHO and $Co(NO_3)_2$, $6H_2O$. Thus, the metal salt, particularly in its nitrate form permits an increase in the conductivity of the suspension and a decrease of the voltage necessary for deposition, e.g. to 40 V/cm. This is of interest, particularly for producing deposits on indium and tin oxide (ITO), because an excessive voltage leads to the reduction of the ITO into black indium.

The presence of metal salt also leads to an improvement of the adhesion of the deposited luminescent material layer enabling it to withstand the necessary washing operations between the deposition of the different layers, e.g. when producing a flat, tricolour screen.

For introducing the metal salt or salts into the organic phase, they are firstly dissolved in a very small amount of water. The metal salt quantity present in the suspension is generally $10^{-4}$ to $10^{-6}$ mole/l.

For further improving the properties of the luminescent material layer deposited by electrophoresis on the basis of the suspension according to the invention, it also incorporates a vegetable protein permitting an improvement of the adhesion of the luminescent material grains to one another and to the substrate.

The vegetable protein or proteins added to the suspension can be simple proteins belonging to the family of prolamines. In particular, it is possible to use prolamine contained in cereal seeds, particularly maize or corn, which is rich in leucine and methionine. As an example of an appropriate protein having a vegetable origin, reference is made to zein obtained from corn. The total vegetable protein quantity added can be between 0.1 and 3 g/l.

The powders of luminescent materials introduced into the suspension can be of different types, but have the finest possible grain size, so as to ensure a stable dispersion of the powder in the suspension in order to limit sedimentation phenomena, which are prejudicial to the obtaining of a uniformly thick deposit over large surfaces. The average grain sizes are equal to or below 20 um, e.g. approximately 1 to 10 μm.

The luminescent materials used can be constituted by any commercially available material having this property, particularly phosphors such as oxides, oxysulphides and sulphides.

The luminescent material powder concentration of the suspension can vary within a wide range and is in general from 1 to 100 g/l.

The suspensions described hereinbefore can be more particularly used for depositing luminescent materials on a transparent insulating substrate coated with an electrically conductive, transparent film, such as an indium and tin oxide film.

The invention also relates to a process for the deposition of a luminescent material on an electrically insulating, transparent substrate coated with an electrically conductive, transparent film, which consists of carrying out the deposition of said material by cataphoresis from a powder suspension of said material having the characteristics given hereinbefore, using the coated substrate as the cathode and a metal anode and by applying a voltage of 1 to 40 V/cm between the anode and the cathode.

The metal anode can be of platinum or stainless steel.

In this deposition process, the control of the electrical parameters during the deposition phase is vital for maintaining the transparency and conductivity properties of the electrically conductive, transparent film. To this end, it is also possible to regulate the distance between the anode and the cathode to an appropriate gap in the range 1 to 5 cm. In the same way, the voltage does not exceed 40 V/cm, because exceeding this value would lead to a deterioration of the transparent, conductive films such as indium and tin oxide films.

In a variant, working takes place at a constant current ensuring that the voltage remains equal to or below 40 V/cm so as not to deteriorate the ITO. It would also be possible to use pulsed currents, but maintaining the voltage equal to or below 40 V/cm.

This deposition process can be used for successively depositing the three colours red, blue and green on tracks corresponding to a flat, tricolour screen and in particular a microtip or microdot screen. In this case, on an electrically insulating, transparent substrate are firstly produced individual, electrically conductive, transparent tracks at the locations corresponding to the three colours to be deposited. Preparation takes place of three suspensions having the characteristic given hereinbefore, but containing for the first suspension a first luminescent material corresponding to the first colour to be deposited, for the second suspension a second luminescent material corresponding to the second colour to be deposited and for the third suspension a third luminescent material corresponding to the third colour. For bringing about the deposition of the first colour, connection takes place of the tracks corresponding to the first colour to an electric current generator and on said tracks is deposited the first colour by performing the process described hereinbefore and using the first suspension. This operation is repeated on the tracks corresponding to the second colour using the second suspension and then on the tracks corresponding to the third colour using the third suspension.

The tracks corresponding to the colours to be deposited and which in general have a very limited width, e.g. 80 μm, can be produced by etching processes as described in FR-A-2 633 763.

BRIEF DESCRIPTION OF THE INVENTION

Other features and advantages of the invention can be gathered from the following, illustrative, non-limitative description with reference to the attached drawings, wherein show:

FIG. 1, already described, in vertical section a cathodoluminescence display means.

Figure 2:
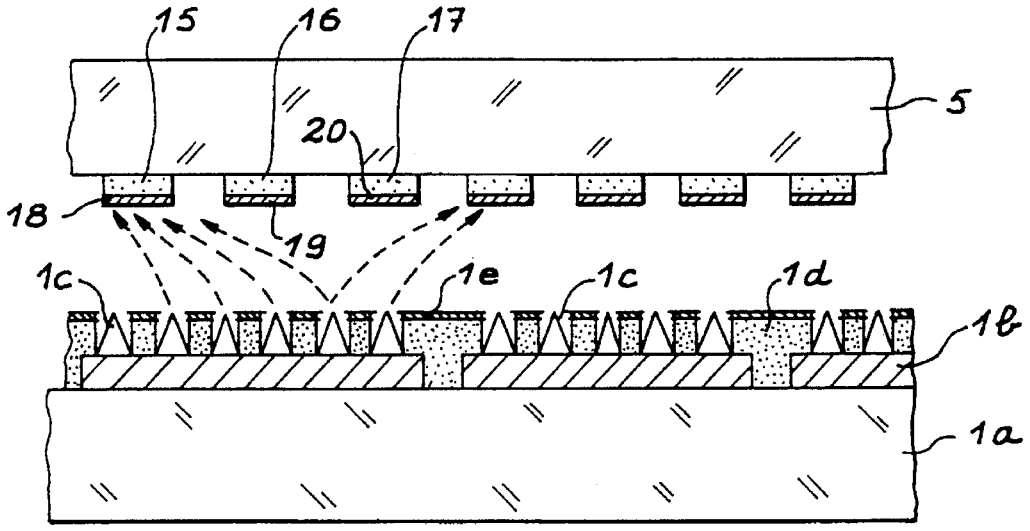

FIG. 2 diagrammatically a microtip, tricolour, cathodoluminescent screen.

FIG. 2 uses the same references as in FIG. 1 for designating common components. In this construction, the anode is slightly different, because the electrically conductive, transparent film supporting the phosphors is constituted by separate tracks 15, 16 and 17 respectively corresponding to the phosphors of the first colour 18, second colour 19 and third colour 20.

A description will now be given of the production of deposits of phosphors 18, 19 and 20 on said individual tracks for producing a 25.4 cm diagonal, microtip or microdot screen.

The tracks are prepared in a conventional manner, being made from indium and tin oxide and have a width of 80 μm. For producing the deposits, preparation takes place of three suspensions in which the organic, solvent phase has the following composition:

nitromethane: 40 vol. %,
isopropyl alcohol: 60 vol. %,
$Mg(NO_3)_2$, $6H_2O$: 5.10 mol/l,
zein : 0.8 g/l.

The first suspension contains 20 g/l of the phosphor ZnS, CuAl, which has an average grain size of 5 μm. The second suspension has as the phosphor a ZnS, Ag powder with an average grain size of 8 μm and the third suspension a ZnCdS, Ag powder with an average grain size of 8 μm.

For bringing about the deposition of the first colour, the tracks 15 corresponding to said first colour are connected to an electric current generator, the substrate 5 coated with the appropriately connected tracks 15 are immersed in the first deposition suspension, followed by deposition placing in front at a distance of 3 cm a platinum anode and applying between said anode and the conductor tracks 15 a voltage of 8 V, with an intensity of 16 mA for 30 sec. This is followed by rinsing with the same alcohol as used in the starting mixture. This gives the deposits 18 of the first colour.

This is followed by the deposits of the second colour by connecting the tracks 16 to the electric current generator, using the second suspension and carrying out deposition under the same conditions as hereinbefore (8 V, 16 mA and 30 sec). After deposition rinsing takes place. This is followed by the deposition of the third colour in the same way, but using the third suspension.

This gives a tricolour screen having adherent deposits, with no mixing of colours and a good thickness uniformity.

The use of the suspensions according to the invention is very interesting, because it permits the production of large screens (up to several dozen inches in diagonal). It is also possible to use the same bath for producing a large number of screens and the life of the suspensions is several months.

Moreover, the quantities of binder and additives contained in the suspension are low and consequently do not affect the light output of the phosphors excited at low voltage.

We claim:

1. A suspension for the deposition of a luminescent material by electrophoresis, comprising:

1) a polar organic solvent constituted by a mixture of nitromethane and an aliphatic alcohol, excepting methyl alcohol;

2) at least one metal salt in solution;

3) at least one vegetable protein in solution; and 4) a powder of a luminescent material to be deposited in suspension in said solvent.

2. Suspension according to claim 1, characterized in that the aliphatic alcohol is isopropyl alcohol.

3. Suspension according to claim 2, characterized in that the organic solvent comprises 40 vol. % of said nitromethane and 60 vol. % of said isopropyl alcohol.

4. Suspension according to claim 1, characterized in that the metal salt is chosen from among alkaline earth metal salts, rare earth salts, thorium salts, aluminum salts and cobalt salts.

5. Suspension according to claim 1 characterized in that the metal salt is hydrogenated magnesium nitrate of formula $Mg(NO_3)_2 \cdot 6H_2O$.

6. Suspension according to claim 1, characterized in that the metal salt has a concentration of $10^{-4}$ to $10^{-6}$ mole/l.

7. Suspension according to claim 1, characterized in that the vegetable protein is a zein.

8. Suspension according to claim 1, characterized in that the protein has a concentration of 0.1 to 3 g/l.

9. Suspension according to claim 1, characterized in that the luminescent material powder has an average grain size equal to or below 20 μm.

10. Suspension according to claim 1, characterized in that the luminescent material powder has a concentration of 1 to 100 g/l.

11. Suspension according to claim 1, characterized in that the luminescent material is a phosphor.

12. Suspension according to claim 1, characterized in that it comprises:

40 vol. % of said nitromethane, 60 vol. % of isopropyl alcohol, as said aliphatic alcohol, 0.8 g/l of zein as said protein, $5.10^{-4}$ mol/l $Mg(NO_3)_2 \cdot H_2O$ as said metal salt, and 20 g/l of the luminescent material powder with an average grain size 5 to 8 μm.

13. Process for the deposition of a luminescent material on an electrically insulating, transparent substrate coated with an electrically conductive, transparent film, characterized in that it consists of carrying out the deposition of said luminescent material by cataphoresis from a powder suspension of said luminescent material in accordance with claim 1, using the coated substrate as the cathode and a metal anode, and applying a voltage of 1 to 40 V/cm between the anode and the cathode.

14. Process according to claim 13, characterized in that the electrically conductive, transparent film is an indium and tin oxide.

15. A process for producing a tricolor, flat screen, comprising:

1) producing on an electrically insulating, transparent substrate individual, conductive, transparent tracks at locations corresponding to the three colors to be deposited;

2) preparing three suspensions comprising
   a) a polar organic solvent constituted by a mixture of nitromethane and an aliphatic alcohol, excepting methyl alcohol;
   b) at least one metal salt in solution;
   c) at least one vegetable protein in solution; and
   d) a powder of a luminescent material to be deposited in suspension in said solvent comprising for said first suspension, a first luminescent material of said first color, for said second suspension, a second luminescent material of said second color, and for said third suspension, a third luminescent material of said third color;

3) depositing said first color by connecting said tracks corresponding to said first color to an electric current generator and by depositing on said tracks, said first color by depositing said first luminescent material by cataphoresis from said first powder suspension of said first luminescent material, using said coated substrate as said cathode, and a metal anode, and applying a voltage of 1 to 40 V/cm between said anode and said cathode, using said first suspension; and 4) repeating said deposition operation on said tracks corresponding to said second color using said second suspension and on said tracks corresponding to said third color using said third suspension.

16. Process according to claim 15, characterized in that the conductive tracks are of indium and tin oxide.

* * * * *

UNITED STATES PATENT AND TRADEMARK OFFICE

CERTIFICATE OF CORRECTION

PATENT NO. : 5,536,383

DATED : July 16, 1996

INVENTOR(S) : Danh TRAN VAN, et al.

It is certified that error appears in the above-indentified patent and that said Letters Patent is hereby corrected as shown below:

On the title page, in Items [19] and [75], the first inventor's name should read:

-- [19] Tran Van et al -- and

-- [75] Danh Tran Van. --

Signed and Sealed this

Twenty-second Day of October, 1996

Bruce Lehman

*Attest:*

BRUCE LEHMAN

*Attesting Officer*

*Commissioner of Patents and Trademarks*